US011858682B2

(12) United States Patent
Andrews

(10) Patent No.: US 11,858,682 B2
(45) Date of Patent: Jan. 2, 2024

(54) CONTAINER OPENING DEVICE, A CLOSURE ARRANGEMENT FOR A CONTAINER, AND A CONTAINER

(71) Applicant: Roland Andrews, Durban (ZA)

(72) Inventor: Roland Andrews, Durban (ZA)

( * ) Notice: Subject to any disclaimer, the term of this patent is extended or adjusted under 35 U.S.C. 154(b) by 642 days.

(21) Appl. No.: 16/315,963

(22) PCT Filed: Jul. 7, 2017

(86) PCT No.: PCT/IB2017/054098
§ 371 (c)(1),
(2) Date: Apr. 5, 2019

(87) PCT Pub. No.: WO2018/007987
PCT Pub. Date: Jan. 11, 2018

(65) Prior Publication Data

US 2019/0144161 A1 May 16, 2019

(30) Foreign Application Priority Data

Jul. 8, 2016 (ZA) ..... 2016/04668

(51) Int. Cl.
*B65D 17/28* (2006.01)

(52) U.S. Cl.
CPC .. *B65D 17/4012* (2018.01); *B65D 2517/0014* (2013.01); *B65D 2517/0056* (2013.01)

(58) Field of Classification Search
CPC ..... B65D 17/4012; B65D 2517/5091; B65D 2517/5072; B65D 2517/5083;
(Continued)

(56) References Cited

U.S. PATENT DOCUMENTS 3,301,431 A * 1/1967 Jasper ..... B65D 17/36 220/273
4,046,283 A * 9/1977 Lockwood ..... B65D 17/4012 220/270
(Continued)

FOREIGN PATENT DOCUMENTS

CN 205240155 5/2016
FR 2849643 7/2004
(Continued)

OTHER PUBLICATIONS

International Search Report and Written Opinion for PCT/IB/2017/054098, dated Sep. 18, 2017, all pages.
(Continued)

*Primary Examiner* — Robert Poon
(74) *Attorney, Agent, or Firm* — Faegre Drinker Biddle & Reath LLP

(57) ABSTRACT

The invention relates generally to containers, particularly to cans (14), for example, for beverages, to a container opening device (9), a container (14), a closure arrangement (12) for a container (14), and a blank for a container opening device (9). The container (14) is typically sealable and has closure (16) attachable thereto to seal the container (14), wherein the closure (16) has a peripherally weakened zone (20), or a partly peripherally weakened zone (20). The container opening device (9) comprises an actuator tab (22) operatively attachable to the closure (16) adjacent the zone (20) such that actuation of the actuator tab (22) between first and second positions causes shearing or detachment of the zone (20) from its weakened periphery thereby to provide an opening to an interior of the container (14), in use; and a pull member (10) attached or attachable to the actuator tab (22) to facilitate actuation of the tab (22) between the first and
(Continued)

second positions. It will be understood that the container (14) and closure arrangement (12) comprise the device.

16 Claims, 9 Drawing Sheets

(58) Field of Classification Search
CPC ..... B65D 2517/5086; B65D 17/4011; B65D 17/02; B65D 17/34; B65D 17/347; B65D 17/353; B65D 1/165; B65D 1/16; B65D 7/04
USPC ..... 220/269
See application file for complete search history.

(56) References Cited

U.S. PATENT DOCUMENTS 4,108,330 A * 8/1978 Patterson ..... B65D 17/505 220/269
4,951,835 A * 8/1990 DeMars ..... B65D 17/4014 220/269
5,647,500 A * 7/1997 Konno ..... B65D 5/708 229/123.1
6,026,971 A * 2/2000 Lundgren ..... B65D 17/4012 220/269
6,062,414 A * 5/2000 Mongarli ..... B65D 17/4012 220/269
2002/0088803 A1* 7/2002 Emmerzaal ..... B65D 17/4011 220/269
2003/0098306 A1* 5/2003 Cho ..... B65D 17/4012 220/269
2006/0201944 A1* 9/2006 Shibasaka ..... B29C 43/18 220/254.1
2007/0181526 A1* 8/2007 Frishman ..... B65D 47/36 215/257
2012/0261380 A1* 10/2012 Frishman ..... B65D 79/0087 215/255

FOREIGN PATENT DOCUMENTS

JP 2001-171662 A 6/2001
JP 2011171662 9/2011

OTHER PUBLICATIONS

International Preliminary Report on Patentability received for PCT Patent Application No. PCT/IB2017/054098, dated Jan. 17, 2019, 7 pages.

* cited by examiner

CONTAINER OPENING DEVICE, A CLOSURE ARRANGEMENT FOR A CONTAINER, AND A CONTAINER

CROSS-REFERENCE TO RELATED APPLICATIONS

This application is a national stage application under 35 U.S.C. 371 of International Application No. PCT/IB2017/054098 having an international filing date of Jul. 7, 2017, which claims the benefit of South Africa Application No. 2016/04668, filed Jul. 8, 2016, each of which is expressly incorporated by reference herein in its entirety as if each were incorporated by reference herein individually.

FIELD OF INVENTION

THIS INVENTION relates generally to containers, particularly to cans, for example, for beverages, to a container opening device, a container, a closure arrangement for a container, and a blank for a container opening device.

BACKGROUND OF INVENTION

Containers, for example, cans have sealable bodies defining cavities suitable for housing its contents. In order to gain access to the contents of the cans in the cavities, some cans are provided which closure arrangements integral with the top of the can which comprise peripherally weakened zones such as peripherally scored zones on the can, and displaceable actuator tabs attached at fulcrums adjacent the zones, wherein the tabs usually lie flat adjacent the zones in a first position in a first plane.

One way in which to open a can of the type described above so as to gain access to its contents is to engage one end of the tab finger and displace the same from the first position to a second position in a second plane transverse to the first plane. For example, in a pivot fashion about the fulcrum thereby causing an opposite end of the tab to urge against the zone urging the same to shear from its weakened periphery due to the force applied thereto from the end of the tab thereby providing an opening to the cavity. The tab is then pivoted back to the first position so as not to obstruct the opening.

An action of the type described above requires a significant amount of finger dexterity and effort, particularly to initially get a grip on the finger tab whilst in the first position as the tabs are usually flush against a surface of the can. In regard, one usually uses their fingernail to be able to raise the tab sufficiently so as to get a grip on the tab for the aforementioned displacement. Consequently, this is problematic for those with delicate nails, long nails, nails with nail polish thereon as they run the risk of damaging their nails. In addition, those with minimal fingernails would struggle to open such cans. To this end, many inconveniently seek external items such as keys, dedicated openers, etc. to open the cans.

It follows that it is thus one object of the present invention to at least ameliorate the aforementioned difficulties associated with opening cans.

SUMMARY OF INVENTION

According to a container opening device, for use with a sealable container having a closure attachable thereto to seal the container, wherein the closure has a peripherally weakened zone, or a partly peripherally weakened zone, wherein the container opening device comprises:

- an actuator tab operatively attachable to the closure adjacent the zone such that actuation of the actuator tab between first and second positions causes shearing or detachment of the zone from its weakened periphery thereby to provide an opening to an interior of the container, in use; and
- a pull member attached or attachable to the actuator tab to facilitate actuation of the tab between the first and second positions.

The pull member may be integrally formed with the actuator tab. The pull member may be flexibly or pliably displaceable between a first position in which the pull member is substantially parallel to the actuator tab, and a second position in which the pull member is substantially transverse to the actuator tab.

The pull member may comprise a loop attached to the actuator tab via one or more suitable flexible connection portions.

It will be noted that the pull member may be constructed from the same material as the actuator tab. In particular, the container opening device is constructed from a planar sheet of pliable metallic material, for example, the metallic material may be selected from a group comprising, aluminium, tin, iron, and an alloy.

The actuator tab may be hingedly attachable to the closure at a hinge connection, such that a free end of the actuator tab is located adjacent the zone, wherein displacement of the actuator tab in a pivot fashion between the first position and the second position about the hinge connection causes the free end of the actuator tab to abut the zone and cause shearing or detachment of the zone from its weakened periphery thereby to provide an opening to an interior of the container, in use.

The actuator tab may be a stay on actuator tab. The actuator tab may be operated to shear the zone from its periphery, the tab may be returned to the first position.

The closure may be provided on a first plane, wherein the actuator tab is generally planar and extends along a second plane, wherein with the actuator tab in the first position the second plane associated with the actuator tab is substantially parallel to the first plane, and wherein in the actuator tab is in the second position, the second plane associated with the actuator tab is substantially transverse to the first plane.

The pull member may be configured to be pulled in a direction transverse to the first plane thereby causing pivotal displacement of the tab about the hinge connection from the first position to the second position, in use.

The pull member may be provided in a third plane, wherein in the case of the pull member being in a first position, the third plane associated therewith is substantially parallel to the second plane associated with the actuator tab, and wherein in the case of the pull member being in a second position, the third plane associated therewith is substantially transverse to the second plane associated with the actuator tab.

The actuator tab may be attached at the hinge connection adjacent the zone such that the free end thereof is positioned above the zone when the actuator tab is in the first position.

The actuator tab may be more rigid than the pull member, for example, by construction or by the material of which the actuator tab is formed from. The actuator tab may be a planar actuator tab which is more rigid adjacent peripheries thereof than one or both of an interior thereof and the pull member.

The end portion of the pull member may comprise an up-turned portion, wherein the up-turned portion extends obliquely from a longitudinal axis of the pull member.

The pull member may be attachable to the actuator tab by way of a suitable attachment member. The attachment member may be attachable to the actuator tab by one or more of an adhesive, a press-stud, and interlocking members.

The attachment member and the pull member may be constructed of a different material to the actuator tab.

According to a second aspect of the invention, there is provided a container closure arrangement for attachment to an open end of a container in suitable fashion so as to provide a sealed container, wherein the container closure arrangement comprises:

a closure having a planar body provided in a first plane, wherein the closure is configured to be attached at peripheries thereof to an open end of the container, wherein the closure defines a peripherally weakened zone, or at least a partly peripherally weakened zone; and a container opening device comprising:

an actuator tab operatively attachable to the closure adjacent the zone such that actuation of the actuator tab between first and second positions causes shearing or detachment of the zone from its weakened periphery thereby to provide an opening to an interior of the container, in use; and a pull member attached or attachable to the actuator tab to facilitate actuation of the tab between the first and second positions.

It will be appreciated that the container opening device may be substantially similar to the device hereinbefore mentioned.

According to a third aspect of the invention, there is provided a container comprising a container opening device or container closure arrangement as hereinbefore described.

According to a fourth aspect of the invention, there is provided a blank for a container opening device for use with a sealable container having a closure attachable thereto to seal the container, wherein the closure has a peripherally weakened zone, or a partly peripherally weakened zone, wherein the blank comprises:

a planar body having an actuation tab portion and an integral pull member portion connected to the actuation tab portion by way of a flexible connection.

It will be noted that the container described herein may be of the type for storing beverages, or food.

DESCRIPTION OF PREFERRED EMBODIMENTS

Figure 1:
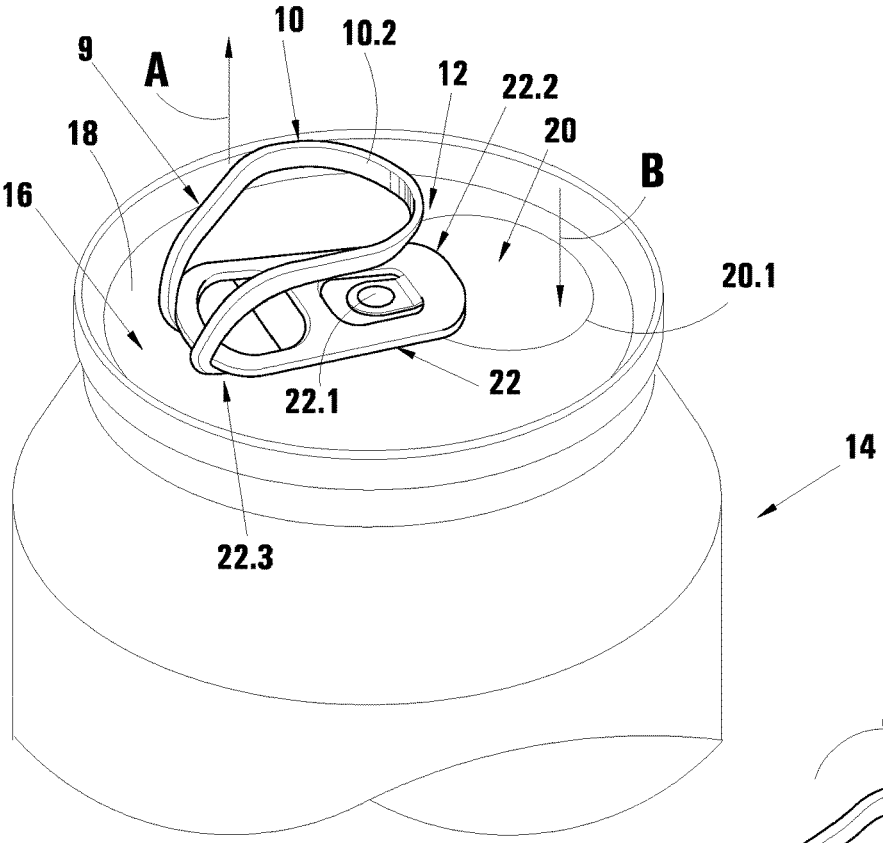
FIG. 1 shows a perspective view of a container opening device in accordance with an example embodiment of the invention.

In the following description, for purposes of explanation, numerous specific details are set forth in order to provide a thorough understanding of an embodiment of the present disclosure. It will be evident, however, to one skilled in the art that the present disclosure may be practiced without these specific details.

Referring to FIGS. 1 to 4 of the drawings, container opening device in accordance with an example embodiment of the invention is generally indicated by reference numeral 9. The device 9 is typically for facilitating ease of operating a closure arrangement 12 of a container, for example, a container in the form of a can 14 so as to gain access to its contents.

In this regard, it will be understood that the can 14 is typically a conventional metal can 14 having a generally cylindrical body defining a cavity which is filled, for example, with a beverage and is sealed by a suitable closure arrangement comprising a closure 16 having a generally planar body 18 which is crimped at peripheries thereof to an open end of the can 12. The closure 16 and comprises zone 20 located in the body 18 which is peripherally weakened or at least partly peripherally weakened, for example, by scoring, perforations, etc. 20.1. It will be appreciated that the zone 20 is weakened at least partly at its periphery so that though it may shear along the part of the periphery which is weakened, it may still be retained on the closure at the periphery which is not suitably weakened.

Figure 3:
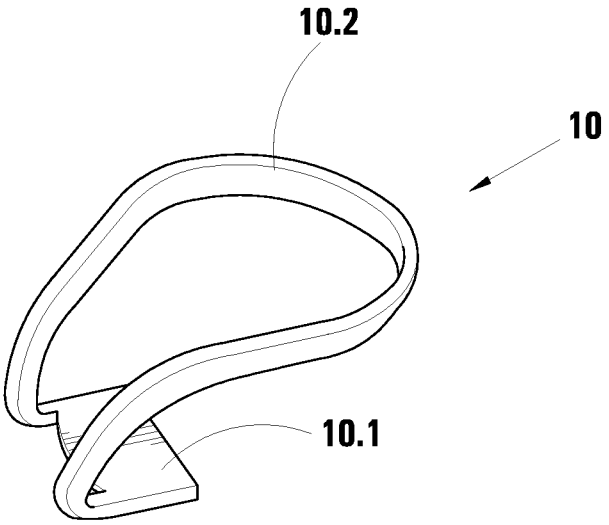
FIG. 3 shows a perspective view of a portion of a can in accordance with an example embodiment of the invention with a device attached to a tab in first position.
Figure 4:
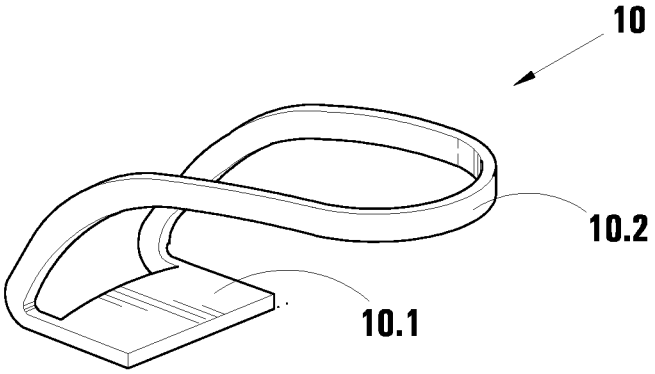
FIG. 4 shows a perspective view of a portion of a can in accordance with an example embodiment of the invention with a device attached to a tab in a second position.

In any event, the device 9 comprises a displaceable actuator tab 22 and a pull member 10 (as best seen in FIGS. 3 and 4) attachable to an end thereof. The member 10 comprises an attachment member 10.1 for attachment to the tab 22, and suitable loop or ring operatively attachable to the member 10.1. The tab 22 is attached via a rivet 22.1 adjacent the zone 20.

Figure 2:
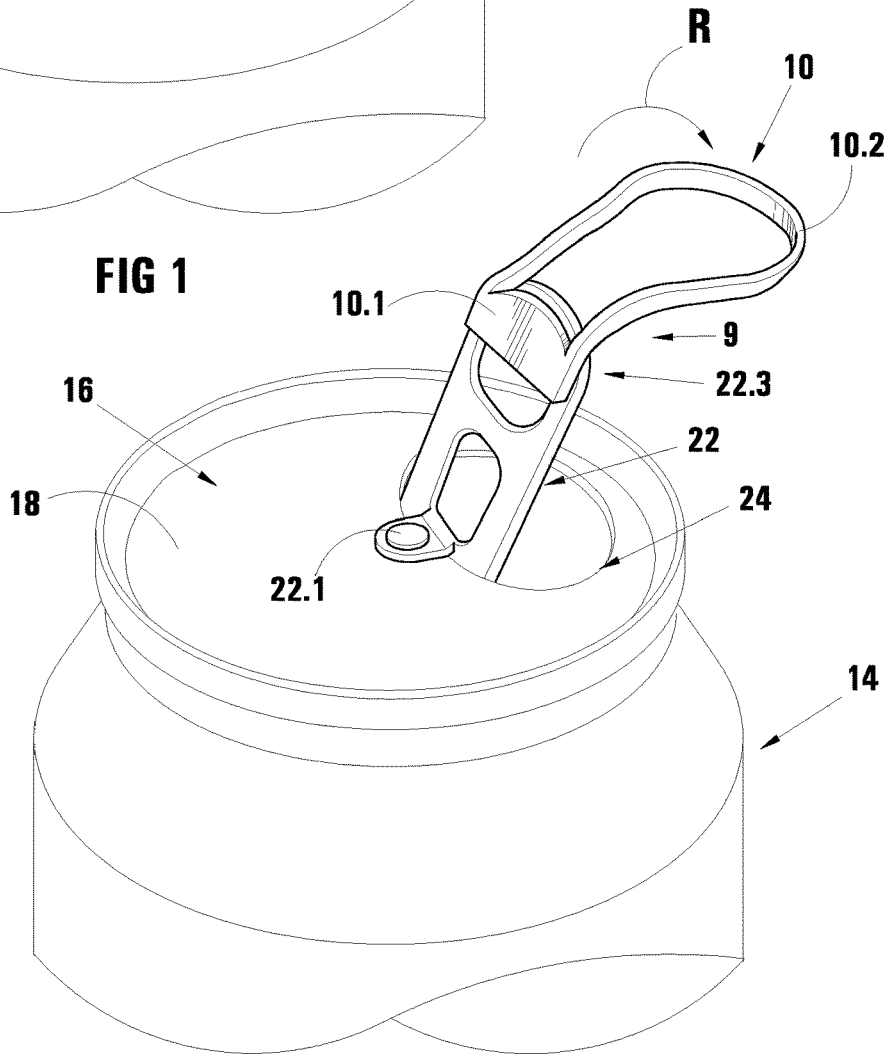
FIG. 2 shows another perspective view of a container opening device in accordance with an example embodiment of the invention.

The tab 22 is typically rigid and has a generally rectangular frame-like construction which is usually stamped and folded in a conventional fashion from a planar sheet of metal. One end 22.2 of the tab 22 projects at least partly over the zone 20 whereas the other end 22.3 is engagable for pivoting the tab 22, about the rivet 22.1, between a first position (as illustrated in FIG. 1) in a first plane which is substantially parallel to, and slightly spaced from, the plane associated with the body 18/closure 16, to a second position (as illustrated in FIG. 2) in a second plane which is substantially transverse to the first plane, and the plane associated with the body 18. It will be appreciated that conventionally, the tab 22 sits substantially close to or flush with the body 18 when in the first position.

The pull member 10, particularly the loop 10.2, is conveniently flexible, more so than the tab 22. It thus follows that the pull member 10 is typically constructed of a more flexible material than the tab 22, for example, a more malleable metal than that of the tab 22, a plastic polymer material, or the like. In some example embodiments, the pull member 10 is more flexible than the tab 22 due to the construction, for example, the tab 22 may be constructed from a folded metal whereby the pull member 10 is constructed with the same material albeit in a manner which allows more flexibility, for example, a rolled wire, or thinner member. It follows that the pull member 10 is a loop-like member and is, for example, shaped and/or dimensioned for ease of engagement of a finger.

In any event, as alluded to above, the attachment member 10.1 is typically attached to the end 22.3 of the tab 22, typically under the tab 22 between the body 18, via an adhesive, welding, rivets, or during forming of the tab 22 by folding such that the same is integral therewith. In one example embodiment, the attachment member 10.1 may be shaped and/or dimensioned to receive the end 22.3 therein. However, to this end, the member 10.1 may comprise a slot to receive the end 22.3 therein. Whatever the means of attachment, it will be appreciated that the attachment member 10.1 effectively anchors the pull member 10 to at least the end 22.3 of the tab 22 in a manner that makes removal of the same difficult.

Though the pull member 10 may be attached to the tab 22 during the construction thereof and subsequently attached with the tab 22 in forming part of the closure arrangement 12, it will be understood that the pull member 10 may be retrospectively attached to the tab 22.1, for example, even after the attachment to the closure arrangement 12.

In construction, the pull member 10 is located on the tab 22 and is affixed thereto by suitable means as described above. In use, once the closure arrangement 12 with the device 9 operatively attached thereto is on the can 14 and a user desired gaining access to its contents, the user easily locates a finger in the flexible loop-like member 10.2 and pulls on the same in a direction transverse to the plane associated with the tab 22 and the body 18. For example, the member 10.2 is pulled upwards in the direction of arrow A (see FIG. 1).

Pulling the end 22.3 upwardly away from the body 18 and in the direction of arrow R (see FIG. 2) causes the tab 22 to be pivotally displaced from the first to the second position about the fulcrum located at the rivet 22.1. The mechanical advantage gained by the displacement of the tab 22 forces the end 22.2 of the tab 22 downwardly in the direction of arrow B (see FIG. 1), transverse to the plane associated with the body 18, thus forcing the zone 20 into shearing away from the body 18 along the scored periphery 20.1 so as to provide an opening aperture 24 to the can 14 as illustrated in FIG. 2. As alluded to above, the zone 20 is typically attached to the body 18 at least partially so that the same is not released into the can 14.

Referring to FIGS. 5 to 9 of the drawings wherein a can 114 comprising a closure arrangement 112, a device 100, and zone 120 substantially similar to that described above is illustrated in accordance with an example embodiment of the invention.

It will be appreciated by those skilled in the field of invention that the description above with respect to the can 14 may extend to similar components of the can 114 in FIGS. 5 to 9, and vice versa. Though substantially similar, the can 114 differs from the can 14 in one particular respect, the device 100 comprises a tab 122, which has a main body 124; and a loop-like pull member 126 operatively connected to the main body 124 of the tab 122, adjacent the end portion 122.3, as an integrally formed component thereof. To this end, the device 100 is constructed from the same material, for example, a metal and is formed from a blank cut from a metal sheet, and bended/rolled into the device 100 as disclosed herein.

The pull member 126 is typically more flexible than the tab 122, particularly, the rigid body 124 thereof, and may be relatively thin and malleable. In one example embodiment, only a portion of the member 126 is flexible or malleable, particularly at an interchange between the member 126 and the rigid body 124 such that the member 126 is displaceable in a pivotal fashion relative to the rigid body 124.

Figure 5:
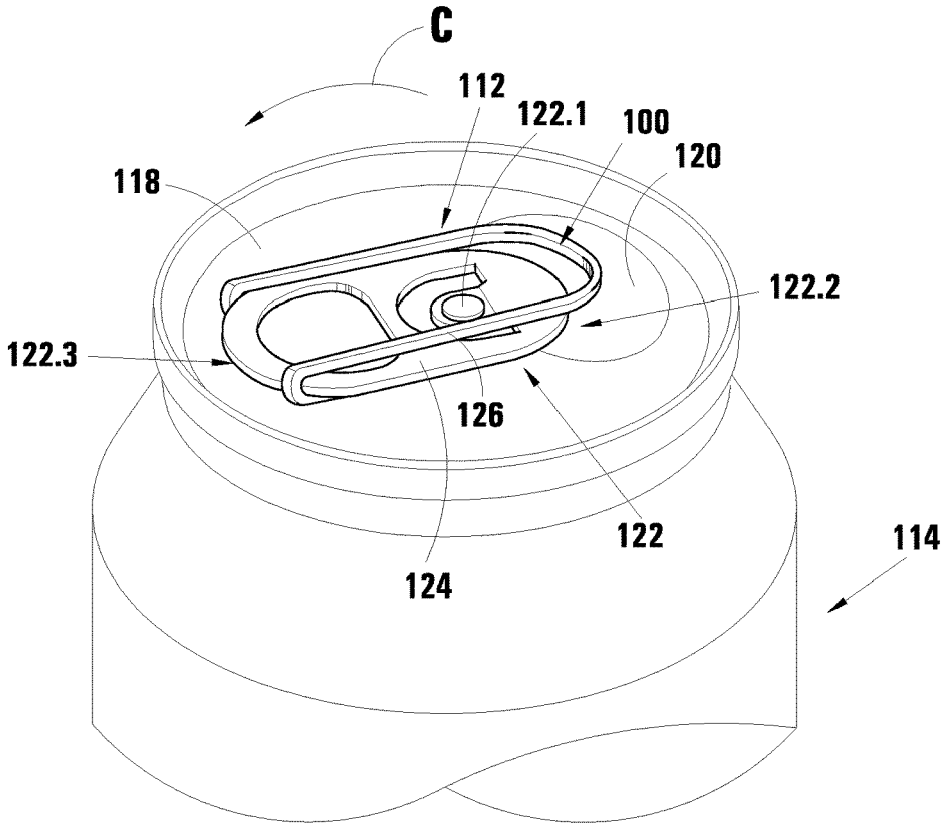
FIG. 5 shows a perspective view of a portion of a can comprising a closure arrangement comprising a tab in accordance with an example embodiment of the invention with a pull member and the tab in a first position.
Figure 6:
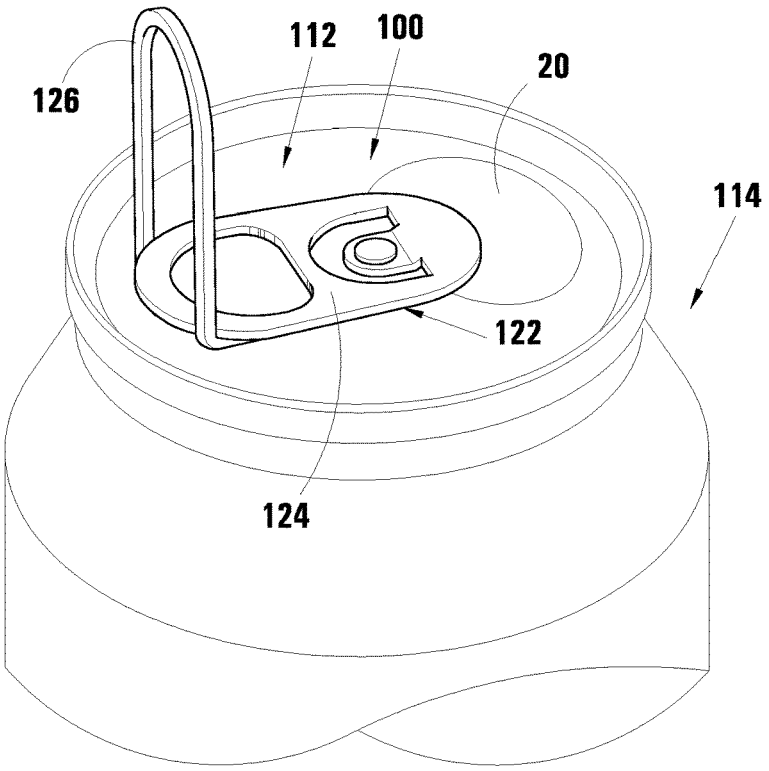
FIG. 6 shows a perspective view of a portion of a can comprising a closure arrangement comprising a tab in accordance with an example embodiment of the invention with the pull member in a second position and the tab in the first position.
Figure 7:
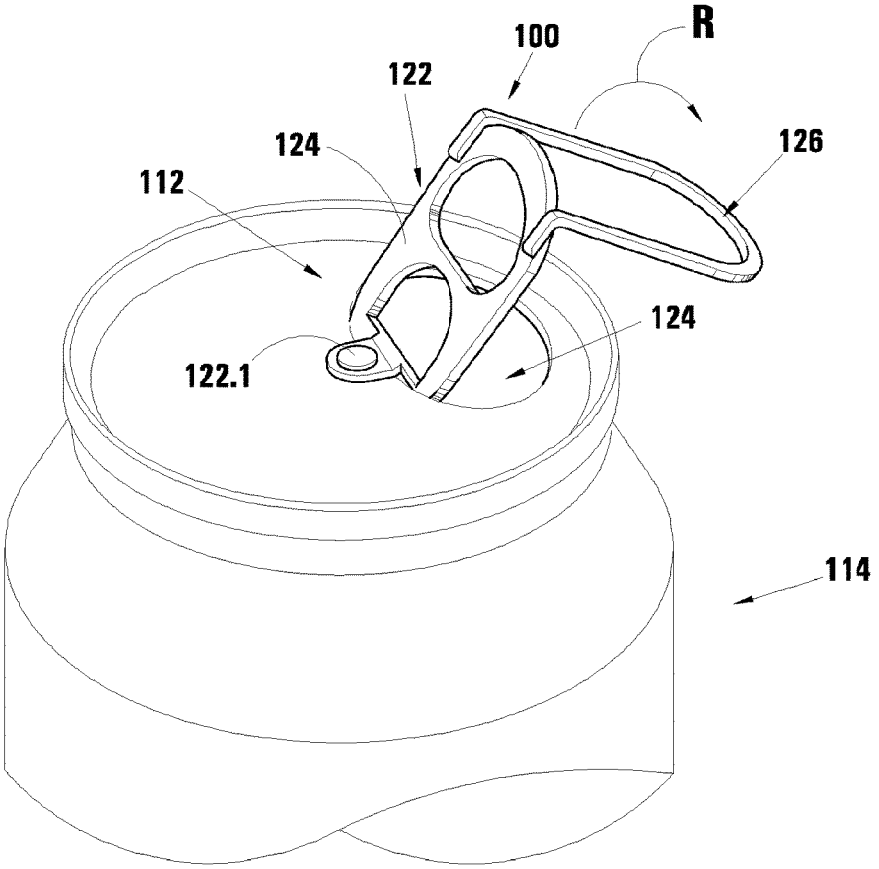
FIG. 7 shows a perspective view of a portion of a can comprising a closure arrangement comprising a tab in accordance with an example embodiment of the invention with the pull member in a second position and the tab in the second position.
Figure 8:
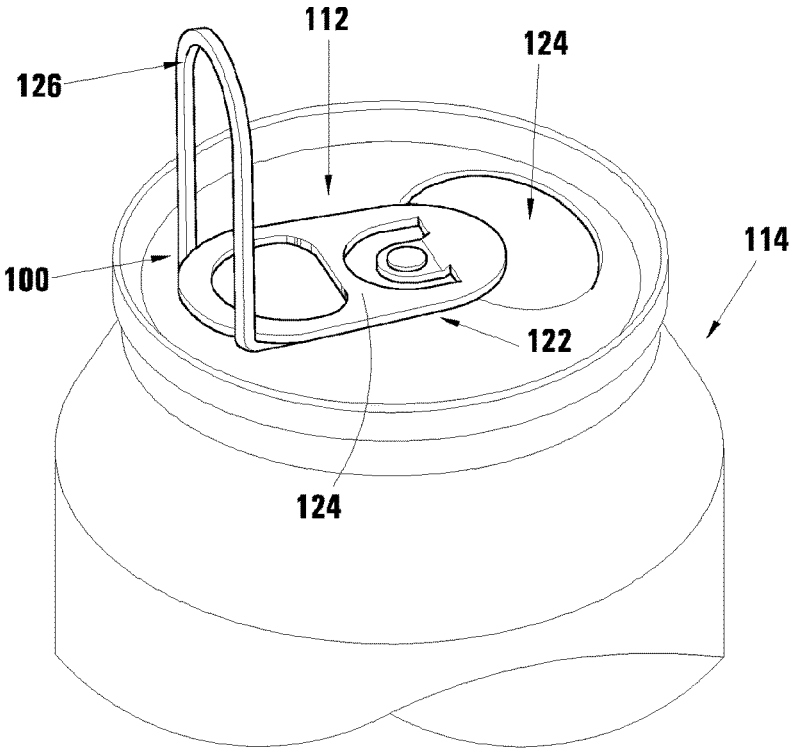
FIG. 8 shows a perspective view of a portion of a can comprising a closure arrangement comprising a tab in accordance with an example embodiment of the invention with the pull member in a second position and the tab in the first position.
Figure 9:
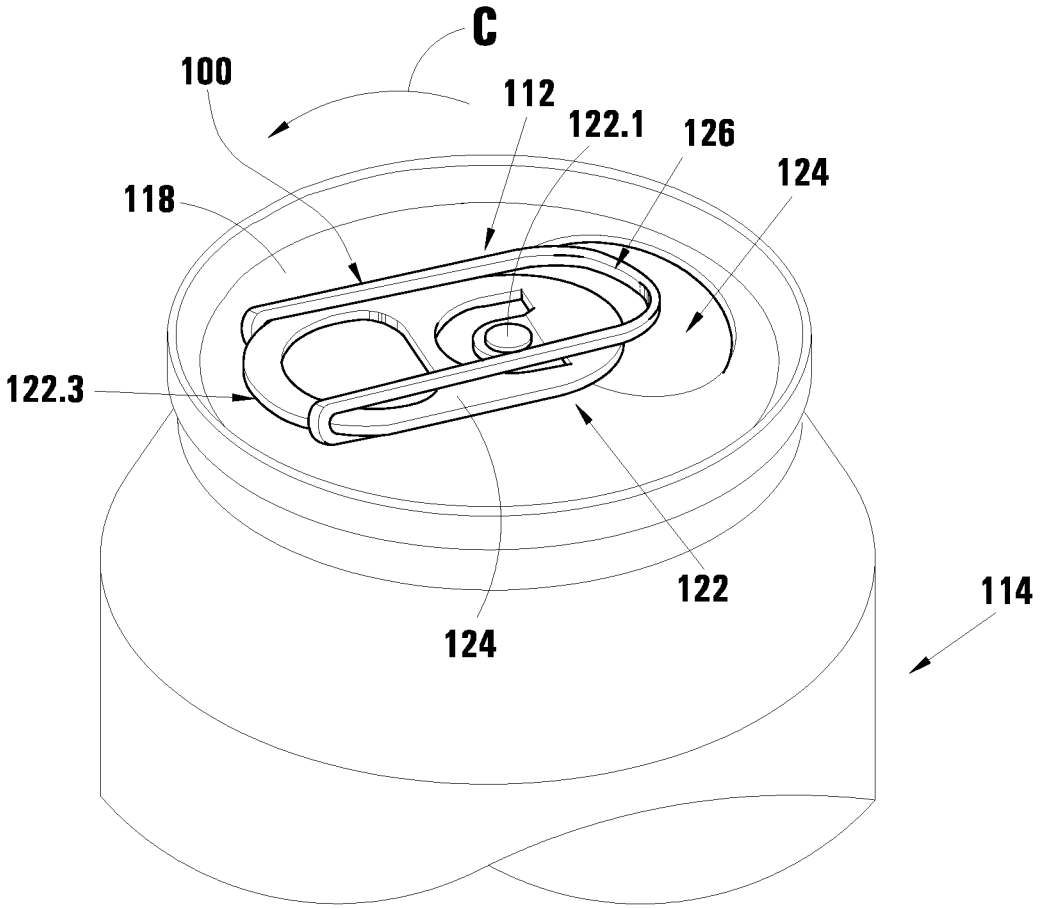
FIG. 9 shows a perspective view of a portion of a can comprising a closure arrangement comprising a tab in accordance with an example embodiment of the invention with the pull member in the first position and the tab in the first position.
Figure 10:
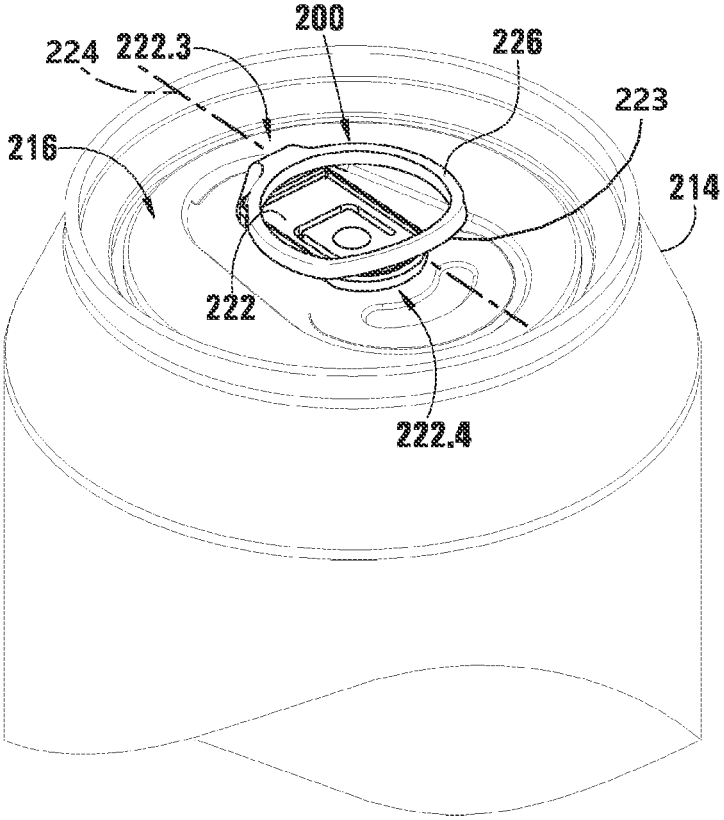
FIG. 10 shows a perspective view of a portion of a can comprising a closure arrangement comprising a tab in accordance with an another example embodiment of the invention with a pull member and the tab in a first position.
Figure 11:
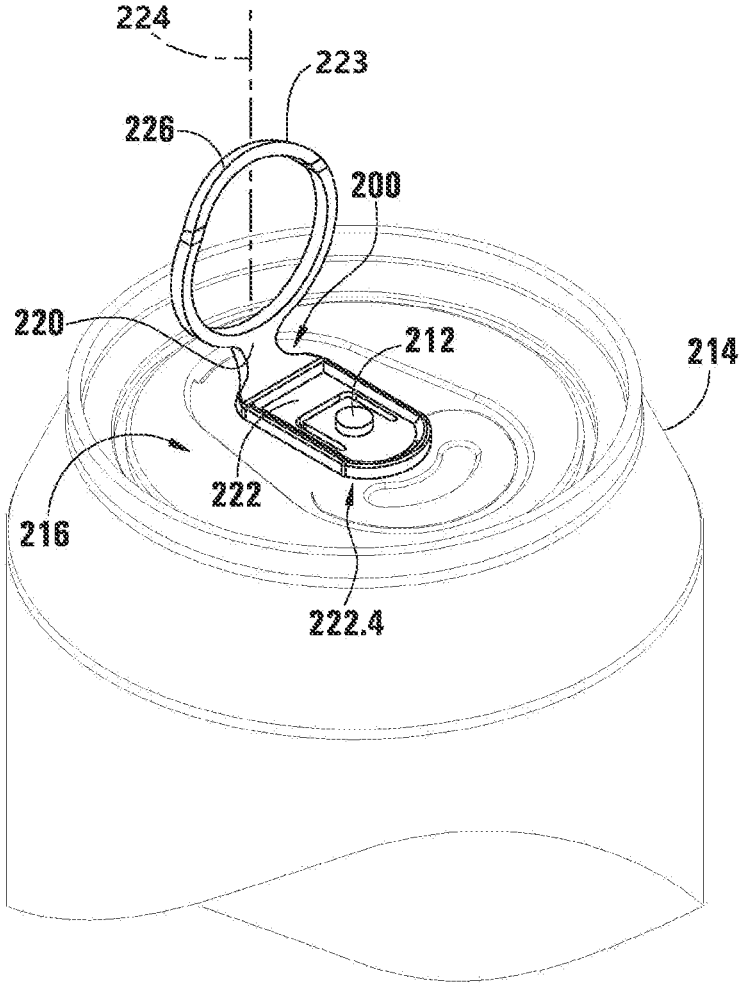
FIG. 11 shows a perspective view of a portion of the can of FIG. 10 with the pull member in a second position and the tab in the first position.
Figure 12:
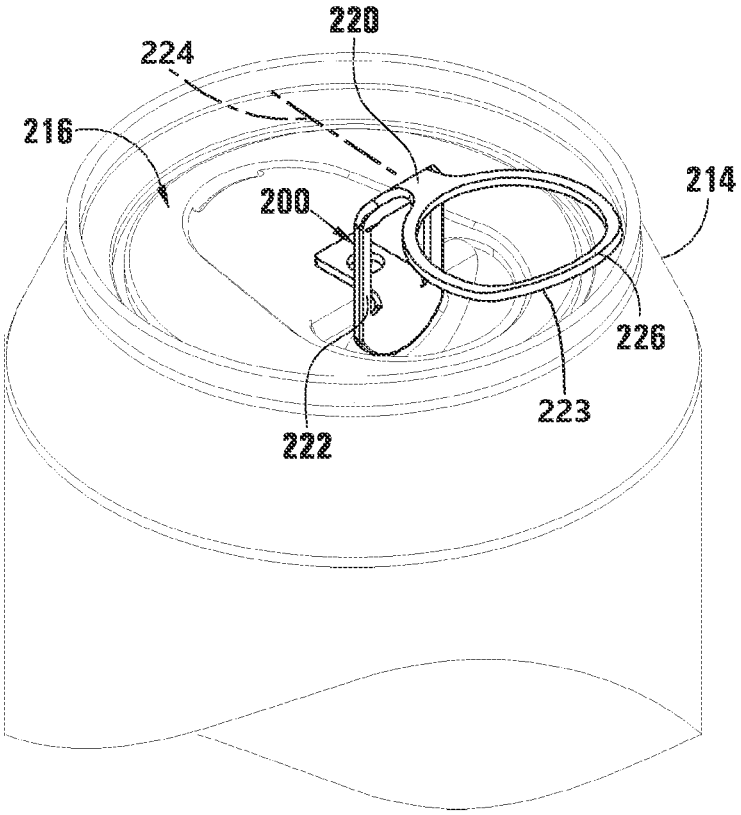
FIG. 12 shows a perspective view of a portion of the can of FIG. 10 with the pull member in a second position and the tab in the second position.
Figure 13:
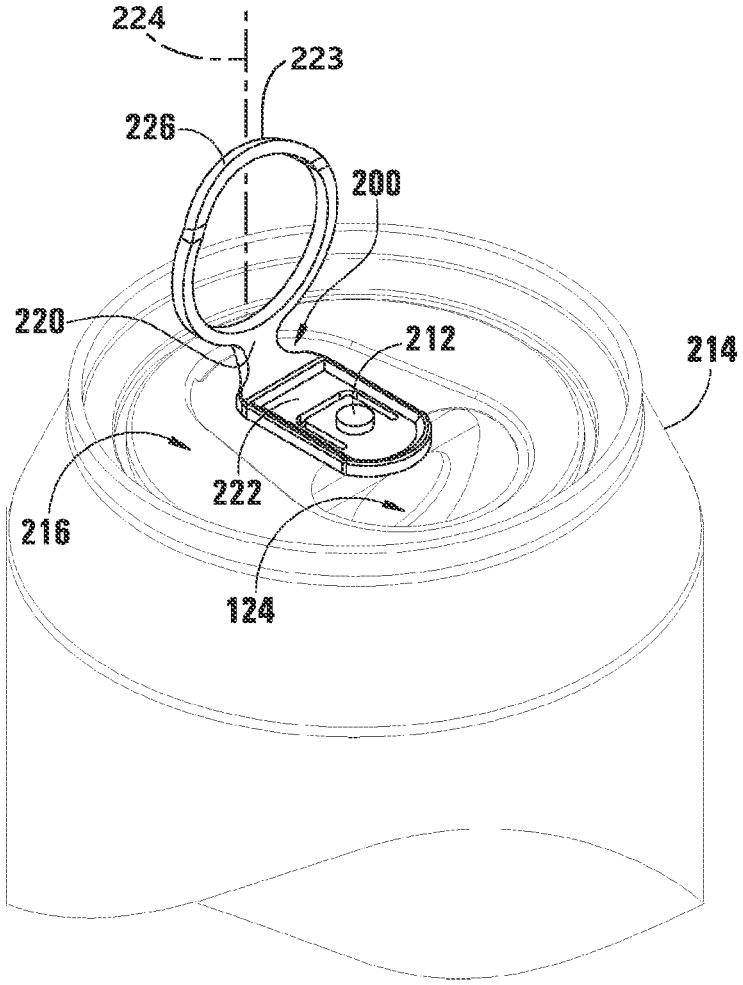
FIG. 13 shows a perspective view of a portion of the can of FIG. 10 with the pulling member in a second position and the tab in the first position.

In particular, the member 126 is flexibly displaceable between a first position as illustrated in FIGS. 5 and 9, wherein in the first position the member 126 is folded onto the rigid body 124 and is located in a plane substantially parallel, but slightly spaced from, the plane associated with the rigid body 124, and a second position as illustrated in FIGS. 6 to 8, wherein in the second position the member 126 is located in a plane substantially transverse to the plane associated with the rigid body 124.

In construction, the tab 122 is typically cut as a blank from a sheet of metal and folded/bent in an automated fashion to form the tab 122 described herein. The tab 122 is attached via a rivet 122.1 to the body 118 of the closure 116, adjacent the zone 120 having a perforated periphery, at least partly.

A beverage, for example, is located in the cylindrical cavity defined by the can 114 and the closure is crimped in a conventional fashion at a circumferential periphery thereof to an open end of the can 114 thereby sealing the contents of the can in an airtight fashion therein.

In use, a user desiring to open the can 114 engages a the loop 126 of the device 100 and as the same is flexible they are easily able to pivot the same in the direction of arrow C (see FIG. 5) about the connection between the member 126 and the rigid body 124 from the first position to the second position.

In a similar fashion as described above, a finger is located in the loop defined by the member 126 and the tab 122 is pulled upwards and in the direction of arrow R (see FIG. 7) so as to cause the tab 122 to be pivotally displaced about the rivet 122.1 from the first position to the second position causing the zone 120 to shear from the body 118 and provide the aperture 124 as illustrated in FIGS. 7 to 9.

Once opened, the tab 22 is optionally then pivoted back to the first position as illustrated in FIG. 8. Similarly, the member 126 is optionally pivoted back to the first position as illustrated in FIG. 9.

Referring now to FIGS. 10 to 13 of the drawings where another device in accordance with a preferred example embodiment is generally indicated by reference numeral 200. The device 200 is attached to a closure arrangement 216 via a suitable rivet 212 as can best be seen in FIG. 11. The closure arrangement 216 is attached to a can 214 so as to seal the can. It will be evident by those skilled in the field of invention that the example embodiment of the invention illustrated in FIGS. 10 to 13 represent a preferred example embodiment of the example embodiment of the invention illustrated in FIGS. 5 to 9 thus the descriptions provided above apply herein with regards to FIGS. 10 to 13 unless otherwise stated.

A difference between the device 100 and the device 200 is that the device 200 comprises a loop or ring-like pull member 226 integrally attached to the actuator tab 222 in a flexible manner via a pliable connecting member 220. In this way, the member 226 may pivot between the first and second positions relative to the tab 222 in a flexible manner as described above. In addition. the pull member 226 includes an up-turned portion 223 at an end thereof. The up-turned portion 223 extends obliquely from the longitudinal axis 224 of the pull member 226 such that when the pull member 226 is in its first position, the pull member 226 is folded onto the actuator tab 222 such that the pull member 226 is located in a plane substantially parallel to a plane associated with the actuator tab 222, and the up-turned portion 223 extends above the plane of the pull member 226. Moreover, apart from the shape and/or dimensions of the tab 222 differing from the tab 122, the tab 222 may define a peripheral ridge or thickened portion so as to give a periphery thereof more structural rigidity adjacent the free end thereof, i.e., end 222.4, opposite end 222.3 which is connected to the member 226.

In use, the use of the device 200 is the substantially similar to the use of the device 100 as hereinbefore described.

The invention as described herein provides a convenient manner in which to open beverage cans, particularly in opening cans of the pull-tab type described herein thereby reducing the potential for damage to nails and obviating the needs for external implements and tools to be able to open the same.

The invention claimed is:

1. A container opening device, for use with a sealable container having a closure attachable thereto to seal the container, wherein the closure has a peripherally weakened zone, or a partly peripherally weakened zone, wherein the container opening device comprises:

an actuator tab configured to operatively attach to the closure adjacent the peripherally weakened zone, the actuator tab comprising a first end that is configured to project at least partly over the peripherally weakened zone, a second opposite end, and a hinge connection that is configured to attach the actuator tab to the closure, the hinge connection being located proximate the first end of the actuator tab such that actuation of the actuator tab between first and second positions of the actuator tab is configured to cause the first end of the actuator tab to abut against the peripherally weakened zone to allow shearing or detachment of the peripherally weakened zone from its weakened periphery thereby to provide an opening to an interior of the container, in use; and a pull member attached to the actuator tab to facilitate actuation of the actuator tab between the first and second positions wherein the pull member is integrally formed with and pivotally attached to the actuator tab, wherein the pull member defines a loop with an up-turned portion at an end portion thereof which is engageable by a finger, or portion thereof, of a user, in use, wherein the pull member is flexibly displaceable relative to the actuator tab between a first position and a second position, wherein the up-turned portion extends obliquely from a longitudinal axis of the pull member such that when the pull member is in the first position, the pull member is folded above the actuator tab such that the pull member is located in a first plane which is substantially parallel to a second plane in which the actuator tab lies and the up-turned portion extends above the first plane and in a third plane extending obliquely from the first plane, the up-turned portion intersecting with a remainder of the loop at a first point disposed on a first side of the longitudinal axis and a second point on a second side of the longitudinal axis, and wherein in the second position of the pull member, the pull member is pivotally displaced in the direction of the second end of the actuator tab such that it is located in a fourth plane substantially transverse to the second plane to allow a finger, or portion thereof, of a user to be locatable in the loop to apply a pulling force on the pulling member to cause actuation of the actuator tab from the first to the second position, in use.

2. The container opening device as claimed in claim 1, wherein the container opening device is constructed from a planar sheet of pliable metallic material; and wherein the metallic material is selected from a group comprising, aluminium, tin, iron, and an alloy.

3. The container opening device as claimed in claim 1, wherein the pull member is configured to be pulled in a direction transverse to a plane of the closure thereby causing pivotal displacement of the tab about the hinge connection from the first position to the second position, in use.

4. The container opening device as claimed in claim 1, wherein the actuator tab is attached at the hinge connection adjacent the peripherally weakened zone such that the free end thereof is configured to be positioned above the peripherally weakened zone when the actuator tab is in the first position.

5. The container opening device as claimed in claim 1, wherein the actuator tab is a planar actuator tab which is more rigid adjacent peripheries thereof than one or both of an interior thereof and the pull member.

6. The container opening device as claimed in claim 1, wherein the first point and the second point define a chord that is perpendicular to the longitudinal axis of the pull member.

7. The container opening device as claimed in claim 1, further comprising a connecting member attaching the actuator tab to the pull member, the connecting member extending from the remainder of the loop and away from the up-turned portion.

8. The container opening device as claimed in claim 1, wherein the up-turned portion defines an arc of the loop extending from the first point to the second point.

9. The container opening device as claimed in claim 1, wherein in the first position a lower surface of the up-turned portion extends above the first plane.

10. A container closure arrangement for attachment to an open end of a container so as to provide a sealed container, wherein the container closure arrangement comprises:

a closure having a planar body provided in a first plane, wherein the closure is configured to be attached at peripheries thereof to an open end of the container, wherein the closure defines a peripherally weakened zone, or at least a partly peripherally weakened zone; and a container opening device comprising:

an actuator tab operatively attachable to the closure adjacent the peripherally weakened zone, the actuator tab comprising a first end that projects at least partly over the peripherally weakened zone, a second opposite end, and a hinge connection that attaches the actuator tab to the closure, the hinge connection being located proximate the first end of the actuator tab such that actuation of the actuator tab between first and second positions of the actuator tab causes the first end of the actuator tab to abut against the peripherally weakened zone to allow shearing or detachment of the peripherally weakened zone from its weakened periphery thereby to provide an opening to an interior of the container, in use; and a pull member attached to the actuator tab to facilitate actuation of the actuator tab between the first and second positions, wherein the pull member is integrally formed with and pivotally attached to the actuator tab, wherein the pull member defines a loop with an up-turned portion at an end portion thereof which is engageable by a finger, or portion thereof, of a user, in use, wherein the pull member is flexibly displaceable relative to the actuator tab between a first position and a second position, wherein the up-turned portion extends obliquely from a longitudinal axis of the pull member such that when the pull member is in the first position, the pull member is folded above the actuator tab such that the pull member is located in a second plane which is substantially parallel to a third plane in which the actuator tab lies and a lower surface of the up-turned portion extends above the second plane and the up-turned portion extends in a fourth plane extending obliquely from the second plane, and wherein in the second position of the pull member, the pull member is pivotally displaced in the direction of the second end of the actuator tab such that it is located in a fifth plane substantially transverse to the third plane to allow a finger, or portion thereof, of a user to be locatable in the loop to apply a pulling force on the pulling member to cause actuation of the actuator tab from the first to the second position, in use.

11. The container closure arrangement as claimed in claim 10, wherein the actuator tab is attached at the hinge connection adjacent the zone such that the free end thereof is positioned above the zone when the actuator tab is in the first position.

12. The container closure arrangement as claimed in claim 10, wherein the actuator tab is a planar actuator tab which is more rigid adjacent peripheries thereof than one or both of an interior thereof and the pull member.

13. The container closure arrangement as claimed in claim 10, wherein the up-turned portion intersects with a remainder of the loop along a chord of the loop.

14. The container closure arrangement as claimed in claim 13, wherein the chord is perpendicular to the longitudinal axis of the pull member.

15. The container closure arrangement as claimed in claim 13, further comprising a connecting member attaching the actuator tab to the pull member, the connecting member extending from the remainder of the loop and away from the up-turned portion.

16. The container closure arrangement as claimed in claim 10, wherein the up-turned portion defines an arc of the loop.

* * * * *